US007147301B2

(12) United States Patent
Powers et al.

(10) Patent No.: US 7,147,301 B2
(45) Date of Patent: Dec. 12, 2006

(54) INK JET PRINTER THAT PRINTS USING CHROMATIC INKS OF MULTIPLE TYPES

(75) Inventors: James H. Powers, Lexington, KY (US); Jack W Morris, Lexington, KY (US); Meagan C. Winkler, Lexington, KY (US); Agnes K. Zimmer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 38 days.

(21) Appl. No.: 10/695,348

(22) Filed: Oct. 28, 2003

(65) Prior Publication Data

US 2005/0088483 A1 Apr. 28, 2005

(51) Int. Cl.
*B41J 2/21* (2006.01)

(52) U.S. Cl. ..... 347/43; 347/40; 347/100

(58) Field of Classification Search ..... 347/100, 347/15, 43

See application file for complete search history.

(56) References Cited

U.S. PATENT DOCUMENTS 4,680,596 A * 7/1987 Logan ..... 347/15
5,521,622 A 5/1996 Hock et al.
5,742,306 A * 4/1998 Gompertz et al. ..... 347/43
6,027,199 A 2/2000 Reed
6,092,887 A 7/2000 Tanino et al.
6,145,961 A 11/2000 Otsuki
6,224,687 B1 5/2001 Inoue
6,293,647 B1 9/2001 Saijo
6,315,387 B1 11/2001 Horikoshi
6,328,405 B1 12/2001 Weber et al.
6,375,308 B1 4/2002 Shimada
6,412,898 B1 7/2002 Danzuka et al.
6,467,896 B1 10/2002 Meyer et al.
6,471,322 B1 10/2002 Kanda et al.
6,512,597 B1 1/2003 Cooper et al.
6,530,637 B1 3/2003 Sawano
6,595,612 B1 7/2003 Brown et al.
6,616,267 B1 9/2003 Weijkamp
6,698,875 B1 * 3/2004 Onishi et al. ..... 347/100
6,705,702 B1 * 3/2004 Gunther et al. ..... 347/43
2001/0015734 A1 8/2001 Kanda et al.
2002/0060706 A1 5/2002 Sawano
2002/0109766 A1 8/2002 Meyer et al.
2002/0140790 A1 10/2002 Moriyama et al.
2002/0163557 A1 11/2002 Du et al.
2003/0030695 A1 2/2003 Doll et al.
2003/0103103 A1 6/2003 Smith

OTHER PUBLICATIONS

U.S. Appl. No. 10/452,545, Morris et al.

* cited by examiner

*Primary Examiner*—Thinh Nguyen
(74) *Attorney, Agent, or Firm*—Taylor & Aust, P.C.

(57) ABSTRACT

An ink jet printer includes a carrier for mounting a first printhead and a second printhead. A first ink reservoir is coupled in fluid communication with the first printhead, and contains a chromatic dye-based ink. A second ink reservoir is coupled in fluid communication with the second printhead, and contains a chromatic pigment-based ink.

26 Claims, 2 Drawing Sheets

INK JET PRINTER THAT PRINTS USING CHROMATIC INKS OF MULTIPLE TYPES

BACKGROUND OF THE INVENTION

1. Field of the Invention

The present invention relates to an ink jet printer, and, more particularly, to an ink jet printer that prints using chromatic inks of multiple types, such as a chromatic dye-based ink and a chromatic pigment-based ink.

2. Description of the Related Art

An ink jet printer forms an image on a print media sheet by ejecting ink from a plurality of ink jetting nozzles of an ink jet printhead to form a pattern of ink dots on the print media sheet. Such an ink jet printer may include a reciprocating printhead carrier that transports multiple ink jet printheads across the print media sheet along a bi-directional scanning path defining a print zone of the printer. Typically, a mid-frame provides media support at or near the print zone. A sheet feeding mechanism is used to incrementally advance the print media sheet in a sheet feed direction, also commonly referred to as a sub-scan direction or vertical direction, through the print zone between scans in the main scan direction, or after all data intended to be printed with the print media sheet at a particular stationary position has been completed.

It is known to provide a unitary printhead cartridge that includes both a printhead and a local supply of ink. Further, it is known to provide a multi-chambered printhead cartridge for carrying multiple colors of ink, or alternatively, to provide individual printhead cartridges, each including a separate supply of ink of a particular color. In one printing system, for example, it is known to mount a multi-chambered printhead cartridge including dye-based cyan (C), magenta (M) and yellow (Y) inks in one receptacle in the printhead carrier and to mount a pigment-based black (K) cartridge in another receptacle in the printhead carrier. These CMY color inks are typically of a single high concentration. However, due to the granularity of images formed with these high concentration inks, it was difficult to create near photographic quality images.

To overcome this granularity problem, diluted inks have been employed. The diluted inks are used to reproduce the less intense colors of the CIELAB system while the more intense colors require the use of the high concentration inks. Typically, only diluted forms of the cyan and magenta are used for a total of six different inks, i.e., cyan, magenta, yellow, black, diluted cyan and diluted magenta (CMYKcm).

The CIELAB system mentioned above is a color space to be used for the specification of color differences. The CIELAB system consists of three variables (L*, a*, and b*) as Cartesian coordinates to form a three-dimensional color space. The L* variable indicates perceived color lightness ranging from 0.0 for black to 100.0 for a diffuse white. The a* and b* dimensions respectively correspond to the red-green and yellow-blue hue/chroma perceptions. Accordingly, color can be defined within the CIELAB system based on lightness, hue ($H^*_{ab}$) and chroma ($C^*_{ab}$), wherein hue is a color in the a* and b* plane represented by a vector angle (hue angle) and chroma is the level of color saturation, ranging from 0.0 (corresponding to an intersection with the lightness (L*) axis) to total saturation, represented by the extent of the vector from the lightness (L*) axis.

As used herein, an achromatic ink is defined as an ink having a chroma of approximately 0 to 10 percent of full saturation on the chroma scale, i.e., substantially lying on the L* axis, ranging from black to white with various shades of gray therebetween, and a chromatic ink is defined as an ink having a chroma greater than 10 percent of full saturation. As an example, a dilute ink and a high concentration ink may have substantially the same hue, e.g., cyan, but will have different chroma, wherein the dilute ink has a relatively lower chroma than the high concentration ink. For example, a high concentration ink may have a chroma of between 80 and 100 percent of full saturation on the chroma scale, whereas the low concentration ink may have a chroma of 20 to 70 percent of full saturation on the chroma scale.

In another known system, printhead cartridges are arranged in the sequence K, A, B, C, M, and Y, with K being a dye-based black ink dispenser, A and B being pigment-based black ink dispensers, C being a dye-based cyan ink dispenser, M being a dye-based magenta ink dispenser, and Y being a dye-based yellow ink dispenser.

What is needed in the art, however, is an ink jet printer that prints using chromatic inks of multiple types, such as a chromatic dye-based ink and a chromatic pigment-based ink.

SUMMARY OF THE INVENTION

The present invention provides an ink jet printer that prints using chromatic inks of multiple types.

In one form thereof, the present invention is directed to an ink jet printer. The ink jet printer includes a carrier for mounting a first printhead and a second printhead. A first ink reservoir is coupled in fluid communication with the first printhead. The first ink reservoir contains a chromatic dye-based ink. A second ink reservoir is coupled in fluid communication with the second printhead. The second ink reservoir contains a chromatic pigment-based ink.

In another form thereof, the present invention is directed to a method of printing, including the step of forming a color image using both a chromatic dye-based ink and a chromatic pigment-based ink.

An advantage of the present invention is that printing with ink types that otherwise may be incompatible can be achieved.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
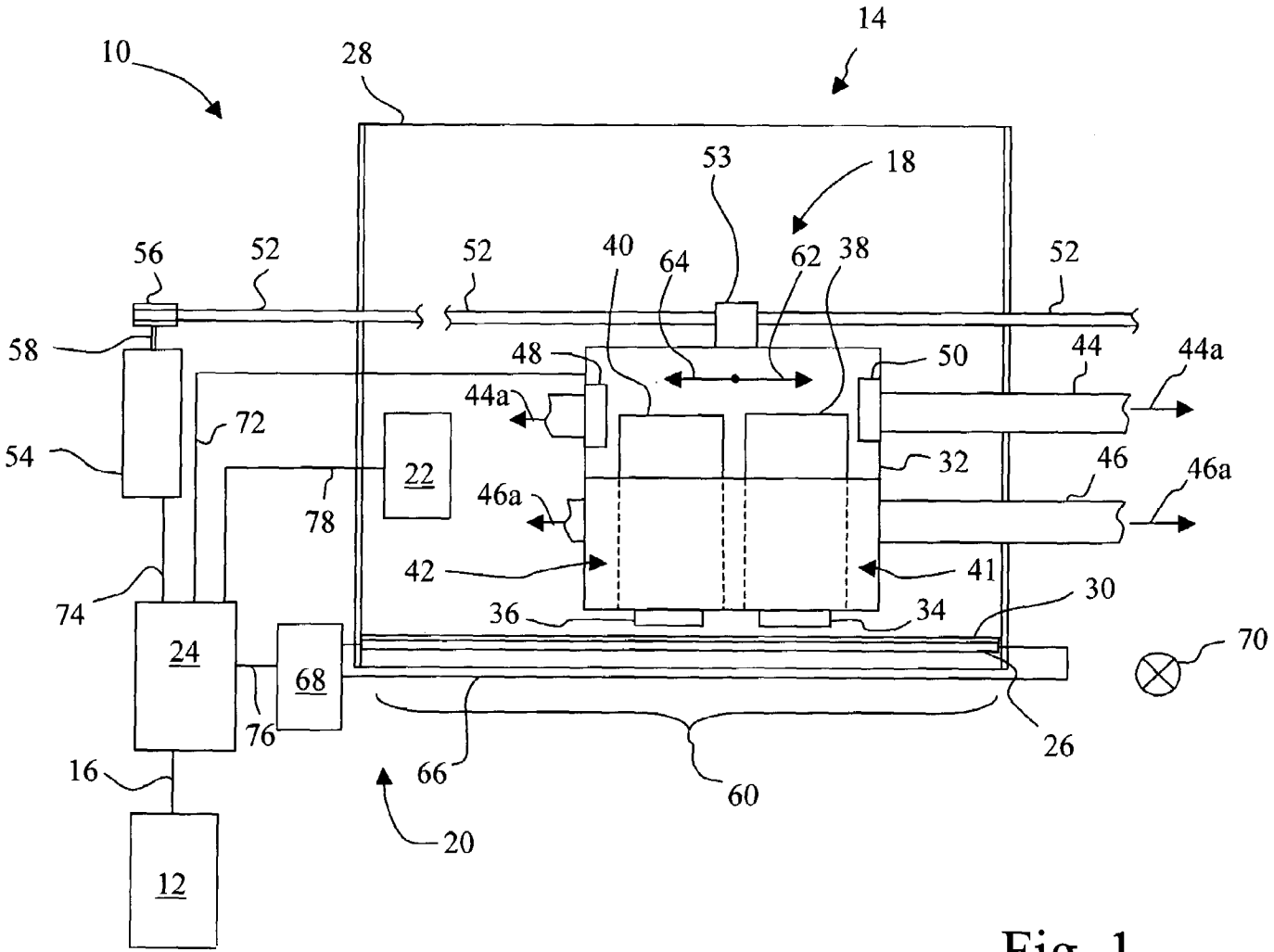
FIG. 1 is an imaging system embodying the present invention.

Referring now to the drawings, and particularly to FIG. 1, there is shown an imaging system 10 embodying the present invention. Imaging system 10 includes a host 12 and an ink jet printer 14. Host 12 is communicatively coupled to ink jet printer 14 via a communications link 16. Communications link 16 may be, for example, a direct electrical or optical connection, or a network connection.

Ink jet printer 14 includes a printhead carrier system 18, a feed roller unit 20, a sheet picking unit 22, a controller 24, a mid-frame 26 and a media source 28.

Host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for ink jet printer 14. The printer driver is in communication with controller 24 of ink jet printer 14 via communications link 16. The printer driver, for example, includes a halftoning unit and a data formatter that places print data and print commands in a format that can be recognized by ink jet printer 14. In a network environment, communications between host 12 and ink jet printer 14 may be facilitated via a standard communication protocol, such as the Network Printer Alliance Protocol (NPAP).

Media source 28 is configured to receive a plurality of print media sheets from which a print medium, e.g., a print media sheet 30, is picked by sheet picking unit 22 and transported to feed roller unit 20, which in turn further transports print media sheet 30 during a printing operation. Print media sheet 30 can be, for example, plain paper, coated paper, photo paper and transparency media.

Printhead carrier system 18 includes a printhead carrier 32 for mounting and carrying a standard color printhead 34 and a photo printhead 36. A standard color ink reservoir 38 is provided in fluid communication with standard color printhead 34, and a photo ink reservoir 40 is provided in fluid communication with photo printhead 36. Those skilled in the art will recognize that color printhead 34 and color ink reservoir 38 may be formed as individual discrete units, or may be combined as an integral unitary printhead cartridge 41. Likewise, photo printhead 36 and photo ink reservoir 40 may be formed as individual discrete units, or may be combined as an integral unitary printhead cartridge 42.

In the embodiment shown in FIG. 1, printhead carrier 32 is guided by a pair of guide members 44, 46, such as guide rods. Each of guide members 44, 46 includes a respective horizontal axis 44*a*, 46*a*. Printhead carrier 32 may include a pair of guide rod bearings 48, 50, each of guide rod bearings 48, 50 including a respective aperture for receiving guide member 44. Printhead carrier 32 further includes a glide surface (not shown) that is retained in contact with guide member 46, for example, by gravitational force, or alternatively, by another guide rod bearing or bearing set. The horizontal axis 44*a* of guide member 44 generally defines a bi-directional scanning path for printhead carrier 32, and thus, for convenience the bi-directional scanning path will be referred to as bi-directional scanning path 44*a*. Accordingly, bi-directional scanning path 44*a* is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide members 44, 46. Carrier motor 54 can be, for example, a direct current (DC) motor or a stepper motor.

The reciprocation of printhead carrier 32 transports ink jet printheads 34, 36 across the print media sheet 30, such as paper, along bi-directional scanning path 44*a* to define a print zone 60 of ink jet printer 14. The reciprocation of printhead carrier 32 occurs in a main scan direction (bi-directional) that is parallel with bi-directional scanning path 44*a*, and is also commonly referred to as the horizontal direction, including a left-to-right carrier scan direction 62 and a right-to-left carrier scan direction 64. Generally, during each scan of printhead carrier 32 while printing, the print media sheet 30 is held stationary by feed roller unit 20.

Mid-frame 26 provides support for the print media sheet 30 when the print media sheet 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold the print media sheet 30 in contact with respective driven feed roller 66. Drive unit 68 includes a drive source, such as a stepper motor, and an associated drive mechanism, such as a gear train or belt/pulley arrangement. Feed roller unit 20 feeds the print media sheet 30 in a sheet feed direction 70, designated as an X in a circle to indicate that the sheet feed direction is out of the plane of FIG. 1 toward the reader. The sheet feed direction 70 is commonly referred to as the vertical direction, which is perpendicular to the horizontal bi-directional scanning path 44*a*, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print media sheet 30, such as for example, by selecting the index feed distance of print media sheet 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable.

Figure 2:
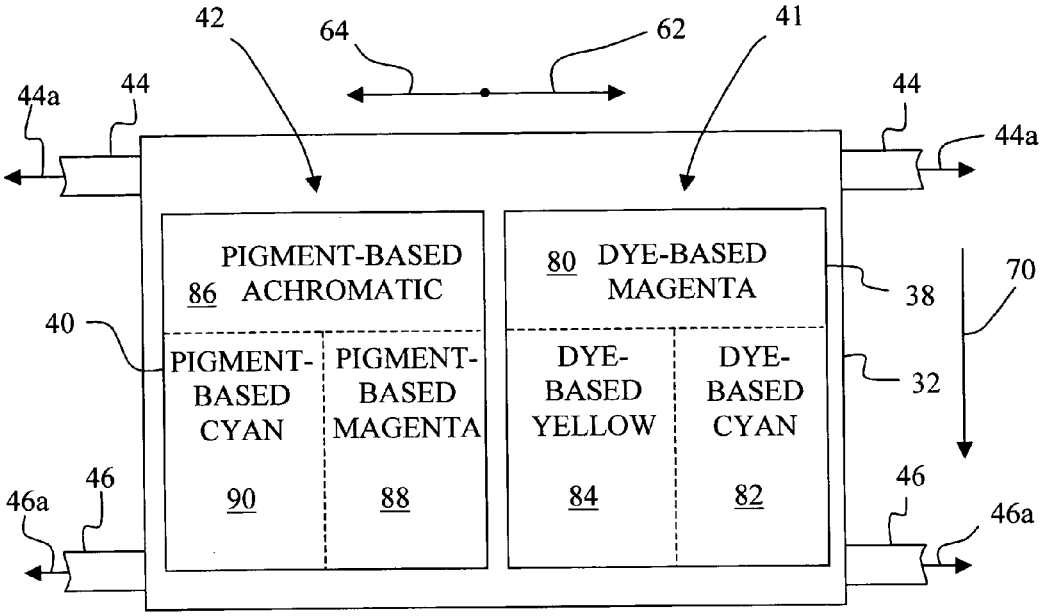
FIG. 2 is a top view of a printhead carrier of the imaging system of FIG. 1, which mounts a plurality of unitary printhead cartridges, with the respective ink chamber dividing walls inside the unitary printhead cartridges represented by dashed lines.

Referring now to FIG. 2 in relation to FIG. 1, there is shown a top view of printhead carrier 32 that mounts unitary printhead cartridge 41 and unitary printhead cartridge 42, with the respective ink chamber dividing walls represented by dashed lines. Accordingly, printhead carrier 32 mounts standard color printhead 34 and photo printhead 36 via their respective printhead cartridges 41, 42.

Unitary printhead cartridge 41 includes standard color ink reservoir 38 coupled in fluid communication with the standard color printhead 34 via a plurality of internal conduits, in a manner known in the art. Standard color ink reservoir 38 includes a plurality of dye-based ink chambers, and in the embodiment shown, three ink chambers 80, 82 and 84, that contain chromatic dye-based ink, such as for example, a dye-based magenta ink, a dye-based cyan ink and a dye-based yellow ink, respectively. Ink chambers 80, 82 and 84 may be configured to define substantially the same volume, and thus may contain substantially the same amount of each of the respective inks.

Unitary printhead cartridge 42 includes photo ink reservoir 40 coupled in fluid communication with the photo printhead 36 via a plurality of internal conduits, in a manner known in the art. Photo ink reservoir 40 includes a plurality of pigment-based ink chambers, and in the embodiment shown, three ink chambers (86, 88, 90), that respectively contain an achromatic pigment-based ink, such as a pigment-based black ink, and chromatic pigment-based inks, such as for example, a pigment-based magenta ink and a pigment-based cyan ink. Ink chambers 86, 88, 90 may be configured to define substantially the same volume, and thus may contain substantially the same amount of each of the respective inks.

With the arrangement described above, the chromatic dye-based inks and the chromatic pigment based inks, which may be generally considered to be incompatible, are separated into two totally separate ink reservoirs, standard color ink reservoir 38 and photo ink reservoir 40. This physical separation translates into a physical separation of corresponding standard color printhead 34 and photo printhead 36 along the bi-directional scanning path 44*a* of printhead carrier 32. This separation, in turn, builds in a drying time between the time that an ink droplet expelled by one of standard color printhead 34 and photo printhead 36 at a particular pixel location on the print media sheet 30 can be contacted by another ink drop expelled from the other of the standard color printhead 34 and photo printhead 36 at the same pixel location, or at an adjacent location where the ink droplets may overlap.

For example, a chromatic dye-based ink droplet expelled by standard color printhead 34 at a particular pixel location on the print media sheet 30 will dry for a time before a corresponding pigment-based ink drop from photo printhead 36 reaches the same pixel location, or an adjacent pixel location, based on the separation distance between the ink jetting nozzles in standard color printhead 34 and the ink jetting nozzles in photo printhead 36 in carrier scan directions 62, 64 along bi-directional scanning path 44*a*, and based on the travel velocity of printhead carrier 32 along bi-directional scanning path 44*a*. Other factors also may be used to extend this time, such as for example, the type of shingling pattern employed by controller 24 or the printer driver in host 12.

As indicated above, standard color ink reservoir 38 containing chromatic dye-based ink and photo ink reservoir 40 containing chromatic pigment-based ink may have inks of substantially the same hue. For example, the hue of the magenta ink in dye-based ink chamber 80 of standard color ink reservoir 38 may have substantially the same hue as the magenta ink in pigment-based ink chamber 88 of photo ink reservoir 40, and likewise, the hue of the cyan ink in dye-based ink chamber 82 of standard color ink reservoir 38 may have substantially the same hue as the cyan ink in pigment-based ink chamber 90 of photo ink reservoir 40. By the term, substantially the same hue, it is meant that the hues may be identical, or may deviate from one another by a hue angle of, for example, ±40 degrees, or more preferably ±30 degrees.

In one embodiment, while the chromatic dye-based ink and chromatic pigment-based ink may have inks of substantially the same hue, each may have a different chroma. For example, the dye-based ink of a particular hue may be a high concentration ink (sometimes referred to as a full strength ink) and may have a chroma of, for example, between 80 and 100 percent of full saturation on the chroma scale, whereas the pigment based ink of substantially the same hue may be of relatively lower ink concentration (sometimes referred to as a diluted ink) and may have a relatively lower chroma of, for example, 20 to 70 percent of full saturation on the chroma scale. In this example, the chromatic pigment-based ink, as a diluted ink, has a lower colorant concentration than the chromatic dye-based ink. Also, in this example, the chromatic pigment-based ink may have a lower optical density than the chromatic dye-based ink.

Figure 3:
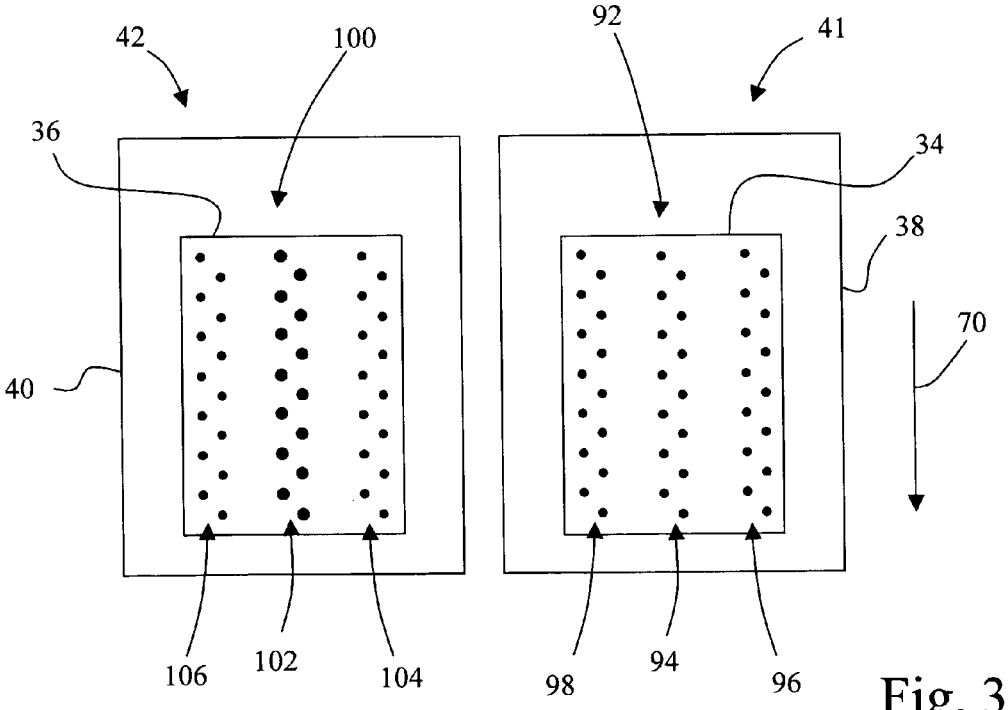
FIG. 3 is a bottom view of the unitary printhead cartridges of FIG. 2, showing a standard color printhead and photo printhead, each in exemplary magnified and exaggerated form for clarity and ease of understanding.

Referring now to FIG. 3, there is shown a bottom view of unitary printhead cartridge 41 including standard color printhead 34, and of unitary printhead cartridge 42 including photo printhead 36. Standard color printhead 34 and photo printhead 36 are show in magnified and exaggerated form for clarity and ease of understanding of their descriptions that follow. Individual ink jetting nozzles for standard color printhead 34 and photo printhead 36 are represented by dots, but the number of nozzles depicted are for exemplary purposes only, and it is to be understood that the number of nozzles for a particular printhead may be dependent on design constraints associated with printheads 34, 36 and ink jet printer 14. Each of standard color printhead 34 and photo printhead 36 may include, for example, a total of 480 nozzles divided into three nozzle arrays including 160 nozzles each.

Standard color printhead 34 includes a plurality of nozzle arrays 92, such as for example, a magenta nozzle array 94, a cyan nozzle array 96 and a yellow nozzle array 98. Magenta nozzle array 94 is coupled in fluid communication with dye-based ink chamber 80 that contains a dye-based magenta ink. Cyan nozzle array 96 is coupled in fluid communication with dye-based ink chamber 82 that contains a dye-based cyan ink. Yellow nozzle array 98 is coupled in fluid communication with dye-based ink chamber 84 that contains a dye-based yellow ink. Of course, the cyan, magenta and yellow inks are chromatic. Nozzle arrays 94, 96, and 98 are arranged to be substantially parallel, and are arranged to be substantially parallel to sheet feed direction 70 when standard color printhead 34 is mounted in printhead carrier 32.

Photo printhead 36 includes a plurality of nozzle arrays 100, such as for example, an achromatic nozzle array 102, a magenta nozzle array 104 and a cyan nozzle array 106. Achromatic nozzle array 102 is coupled in fluid communication with pigment-based ink chamber 86 that contains a pigment-based achromatic ink, such as for example, black. Magenta nozzle array 104 is coupled in fluid communication with pigment-based ink chamber 88 that contains a pigment-based magenta ink. Cyan nozzle array 106 is coupled in fluid communication with pigment-based ink chamber 90 that contains a pigment-based cyan ink. Of course, the cyan and magenta inks are chromatic. Nozzle arrays 102, 104 and 106 are arranged to be substantially parallel, and are arranged to be substantially parallel to sheet feed direction 70 when photo printhead 36 is mounted in printhead carrier 32.

As shown in FIG. 3, achromatic nozzle array 102 for jetting the achromatic ink, e.g., black ink, is positioned between the chromatic nozzle arrays 104, 106 that jet chromatic inks, and in the embodiment shown, which jet magenta and cyan pigment-based inks, respectively. As depicted in FIG. 3, the nozzle size, e.g., diameter, of the nozzles of achromatic nozzle array 102 is larger than the nozzle size, e.g., diameter, of the nozzles of the chromatic nozzle arrays 104, 106, thus resulting in a larger drop mass of an achromatic ink drop in comparison to a chromatic ink drop, for a given amount of jetting energy supplied to ink jetting heaters of the respective achromatic nozzle array 102 and chromatic nozzle arrays 104, 106. For example, each nozzle of achromatic nozzle array 102 may be sized to produce an achromatic ink drop having a mass of about 9 nanograms, or a volume of about 9 picoliters, whereas each nozzle of chromatic nozzle arrays 104, 106 may be sized to produce a respective chromatic drop mass of about 5 nanograms, or a volume of about 5 picoliters.

Further, due to the positioning of achromatic nozzle array 102 between chromatic nozzle arrays 104, 106, more residual heat is retained in the vicinity of achromatic nozzle array 102 in comparison to chromatic nozzle arrays 104, 106, thereby lowering the viscosity of the achromatic ink at achromatic nozzle array 102, and in turn further contributing to an increase in drop mass relative to the drop mass of ink drops expelled from chromatic nozzle arrays 104, 106.

As previously mentioned, controller 24 is electrically coupled to each of standard color printhead 34 and photo printhead 36. Controller 24 may be configured, either using hardware, firmware or software principles, to form a single color image on a print medium, e.g., the print media sheet 30, using both chromatic dye-based ink and chromatic pigment-based ink, wherein chromatic dye-based ink drops and chromatic pigment-based ink drops may be layered, or be overlapping, in forming the color image, as dictated by the drop placement map implemented by controller 24.

As indicated above, in one exemplary embodiment, the chromatic dye-based ink and the chromatic pigment-based ink have substantially the same hue, but have different chroma, different ink concentration, and/or different optical density. For example, the chromatic pigment-based ink may have a lower chroma than the chromatic dye-based ink, the chromatic pigment-based ink may have a lower colorant concentration than the chromatic dye-based ink, and/or the chromatic pigment-based ink may have a lower optical density than the chromatic dye-based ink.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer, comprising:

a carrier for mounting a first printhead and a second printhead;

a first ink reservoir coupled in fluid communication with said first printhead, said first ink reservoir containing a chromatic dye-based ink;

a second ink reservoir coupled in fluid communication with said second printhead, said second ink reservoir containing a chromatic pigment-based ink, wherein a physical separation between said first printhead and said second printhead relative to a scanning direction of said first printhead and said second printhead builds in a drying time between a time that a chromatic dye-based ink drop expelled by said first printhead contacts a chromatic pigment-based ink drop expelled from said second printhead at a particular pixel location on a print media sheet or at an adjacent location on said print media sheet where said chromatic dye-based ink drop and said chromatic pigment-based ink drop may overlap.

2. The ink jet printer of claim 1, wherein said chromatic dye-based ink and said chromatic pigment-based ink have substantially the same hue, but different chroma.

3. The ink jet printer of claim 2, wherein said hue is one of cyan and magenta.

4. The ink jet printer of claim 2, wherein said chromatic pigment-based ink has a lower optical density than said chromatic dye-based ink.

5. The ink jet printer of claim 2, wherein said chromatic pigment-based ink has a lower colorant concentration than said chromatic dye-based ink.

6. The ink jet printer of claim 2, wherein said chromatic pigment-based ink has a lower chroma than said chromatic dye-based ink.

7. The ink jet printer of claim 2, wherein said chromatic pigment-based ink has a lower chroma than said chromatic dye-based ink by at least 10 percent of full saturation.

8. The ink jet printer of claim 1, wherein said chromatic pigment-based ink has a lower optical density than said chromatic dye-based ink.

9. The ink jet printer of claim 1, said second ink reservoir including a plurality of ink chambers containing a plurality of chromatic pigment-based inks, each having a respective hue, and said second printhead including a plurality of nozzle arrays, wherein a first nozzle array of said plurality of nozzle arrays is coupled in fluid communication with a first ink chamber of said plurality of ink chambers that contains a first chromatic ink having a first hue, and a second nozzle array of said plurality of nozzle arrays is coupled in fluid communication with a second ink chamber of said plurality of ink chambers that contains an achromatic ink.

10. The ink jet printer of claim 9, said second ink reservoir including a third nozzle array coupled in fluid communication with a third ink chamber containing a second chromatic ink having a second hue different from said first hue, said second nozzle array for jetting said achromatic ink being positioned between said first nozzle array for jetting said first chromatic ink having said first hue and said third nozzle array for jetting said second chromatic ink having said second hue.

11. The ink jet printer of claim 10, wherein said first chromatic ink is one of cyan and magenta, and the second chromatic ink is the other of cyan and magenta.

12. The ink jet printer of claim 11, wherein said achromatic ink is black.

13. The ink jet printer of claim 9, wherein said achromatic ink is black.

14. The ink jet printer of claim 9, said first ink reservoir including a plurality of ink chambers containing a respective plurality of chromatic dye-based inks, each having a respective hue, at least one of said plurality of chromatic dye-based inks having a hue that is substantially the same as at least one of said plurality of chromatic pigment-based inks in said second ink reservoir.

15. The ink jet printer of claim 14, wherein of said plurality of chromatic dye-based inks in said first ink reservoir and said plurality of chromatic pigment-based inks in said second ink reservoir that have substantially the same hue, their respective chromas are different by at least 10 percent of full saturation.

16. The ink jet printer of claim 1, further comprising a controller electrically coupled to each of said first printhead and said second printhead, said controller being configured to form a color image on a print medium using both said chromatic dye-based ink and said chromatic pigment-based ink.

17. The ink jet printer of claim 16, wherein said chromatic dye-based ink and said chromatic pigment-based ink have substantially the same hue, but different chroma.

18. The ink jet printer of claim 1, wherein said first printhead and said first ink reservoir are configured as a first unitary printhead cartridge.

19. The ink jet printer of claim 18, wherein said second printhead and said second ink reservoir are configured as a second unitary printhead cartridge.

20. A method of printing, comprising the step of forming a color image using both a chromatic dye-based ink ejected from a first printhead and a chromatic pigment-based ink ejected from a second printhead, wherein a physical separation between said first printhead and said second printhead relative to a scanning direction of said first printhead and said second printhead builds in a drying time between a time that a chromatic dye-based ink drop expelled by said first printhead contacts a chromatic pigment-based ink drop expelled from said second printhead at a particular pixel location on a print media sheet or at an adjacent location on said print media sheet where said chromatic dye-based ink drop and said chromatic pigment-based ink drop may overlap.

21. The method of claim 20, wherein said chromatic dye-based ink and said chromatic pigment-based ink have substantially the same hue, but different chroma.

22. The method of claim 21, wherein said hue is one of cyan and magenta.

23. The method of claim 21, wherein said chromatic pigment-based ink has a lower optical density than said chromatic dye-based ink.

24. The method of claim 21, wherein said chromatic pigment-based ink has a lower colorant concentration than said chromatic dye-based ink.

25. The method of claim 21, wherein said chromatic pigment-based ink has a lower chroma than said chromatic dye-based ink.

26. The method of claim 20, wherein chromatic dye-based ink drops and chromatic pigment-based ink drops may be layered, or be overlapping, in forming said color image.

* * * * *